US006470717B1

(12) United States Patent
Yu

(10) Patent No.: US 6,470,717 B1
(45) Date of Patent: Oct. 29, 2002

(54) DIALS OF A COMBINATION PADLOCK

(76) Inventor: Chun-Te Yu, N.253, Sec.3, Yen-Hi Rd., Fu shing Hsiang Chang-Hwa Hsien (TW)

( * ) Notice: Subject to any disclaimer, the term of this patent is extended or adjusted under 35 U.S.C. 154(b) by 0 days.

(21) Appl. No.: 09/847,363

(22) Filed: May 3, 2001

(51) Int. Cl.[7] ..... E05B 37/14
(52) U.S. Cl. ..... 70/25; 70/312
(58) Field of Search ..... 70/25, 26, 312, 70/22, 24, 27–29

(56) References Cited

U.S. PATENT DOCUMENTS 221,258 A * 11/1879 Walker ..... 70/25
345,340 A * 7/1886 Volke ..... 70/25
1,716,184 A * 6/1929 Poturnaj ..... 70/25
1,940,789 A * 12/1933 Diaz ..... 70/25
3,824,816 A * 7/1974 Dobrjanskyj et al. ..... 70/25
3,973,419 A * 8/1976 Atkinson ..... 70/25 X
4,476,698 A * 10/1984 Treslo ..... 70/25
4,742,700 A * 5/1988 Ling ..... 70/25
4,866,959 A * 9/1989 Ling ..... 70/25
4,899,559 A * 2/1990 Chern ..... 70/25
5,396,785 A * 3/1995 Chen ..... 70/25
5,520,032 A * 5/1996 Ling ..... 70/25

* cited by examiner

*Primary Examiner*—Suzanne Dino Barrett
(74) *Attorney, Agent, or Firm*—Harrison & Egbert

(57) ABSTRACT

A combination padlock has a lock mechanism, which includes two dials, with each being mounted on a shaft rod to prevent the two dials from being interfered with each other. The two dials partially jut out of the housing of the combination padlock to facilitate the turning of the dials with fingers at the same time.

1 Claim, 7 Drawing Sheets

DIALS OF A COMBINATION PADLOCK

BACKGROUND OF THE INVENTION

1. Field of the Invention

The present invention relates generally to a combination padlock, and more particularly to the dials of the combination padlock.

2. Description of Related Art

The conventional combination padlock comprises a plurality of dials, which are mounted at intervals on the same shaft rod. The dials are provided with a plurality of numbers. When the dials are turned to a set series of numbers, the mechanism works to open the padlock.

The conventional combination padlock is defective in design because the dials are mounted on the same shaft rod and are therefore apt to turn at the time when one of the dials is turned. In addition, the set series of numbers of the padlock are not clearly exhibited to prevent confusion.

BRIEF SUMMARY OF THE INVENTION

The primary objective of the present invention is to provide a combination padlock which is free of the drawbacks of the conventional combination padlock described above.

In keeping with the principle of the present invention, the foregoing primary objective of the present invention is achieved by a combination padlock which is characterized by a lock mechanism comprising two dials, which each being mounted on a shaft rod to prevent the two dials from being interfered with each other. The two dials partially jut out of the housing such that the two dials can be turned simultaneously. The combination of numbers of the dials can be easily seen through the windows of the cover of the housing.

The features and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
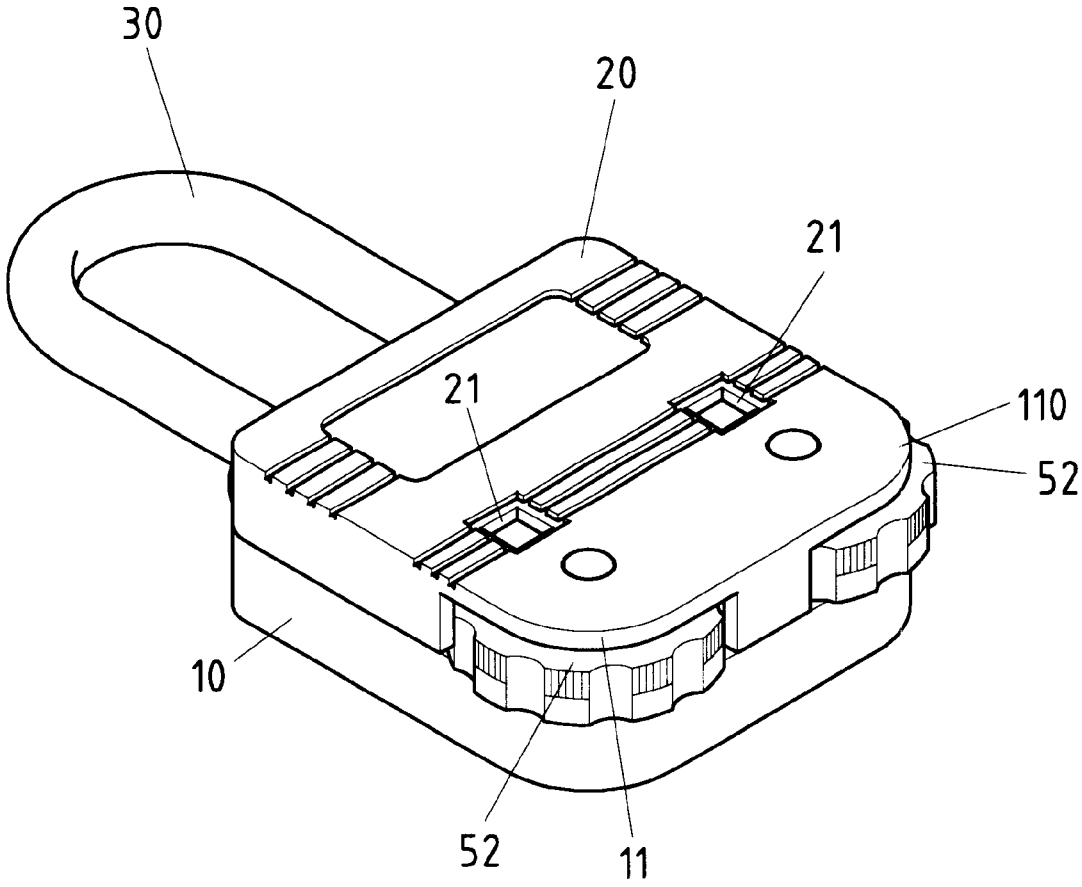
FIG. 1 shows a perspective view of the preferred embodiment of the present invention.
Figure 2:
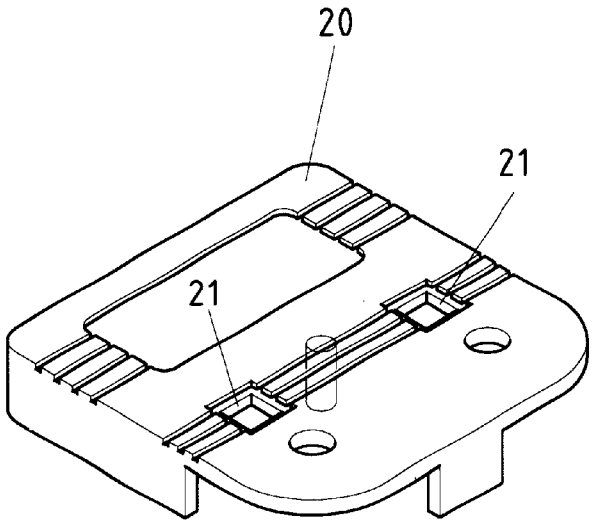
FIG. 2 shows a partial exploded view of the preferred embodiment of the present invention.
Figure 2:
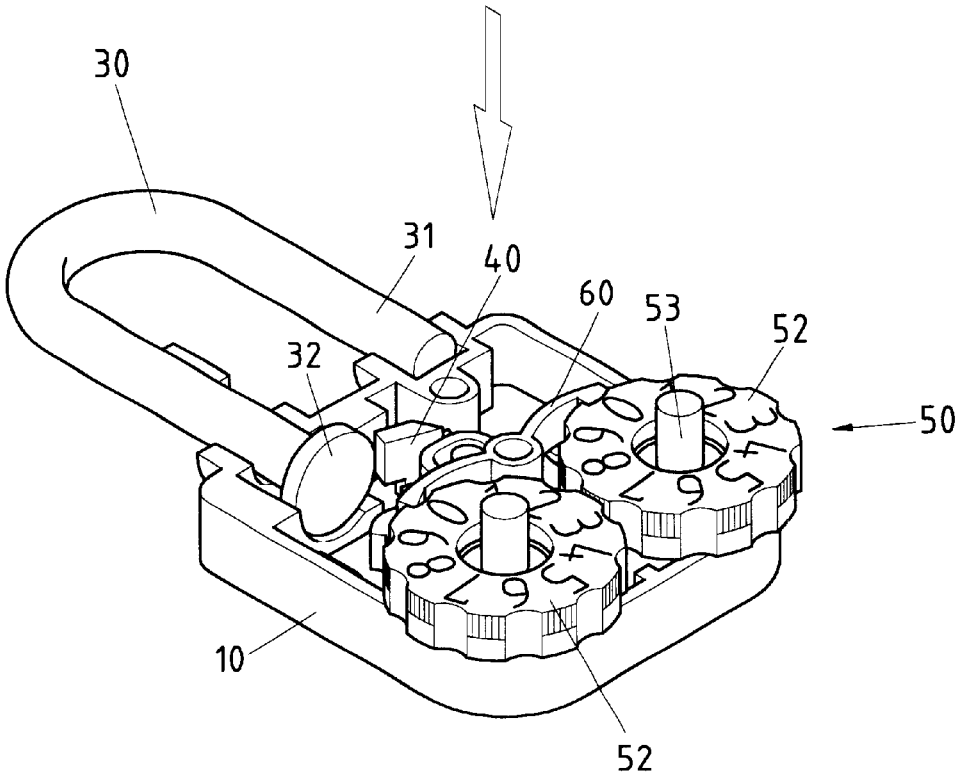
Figure 3:
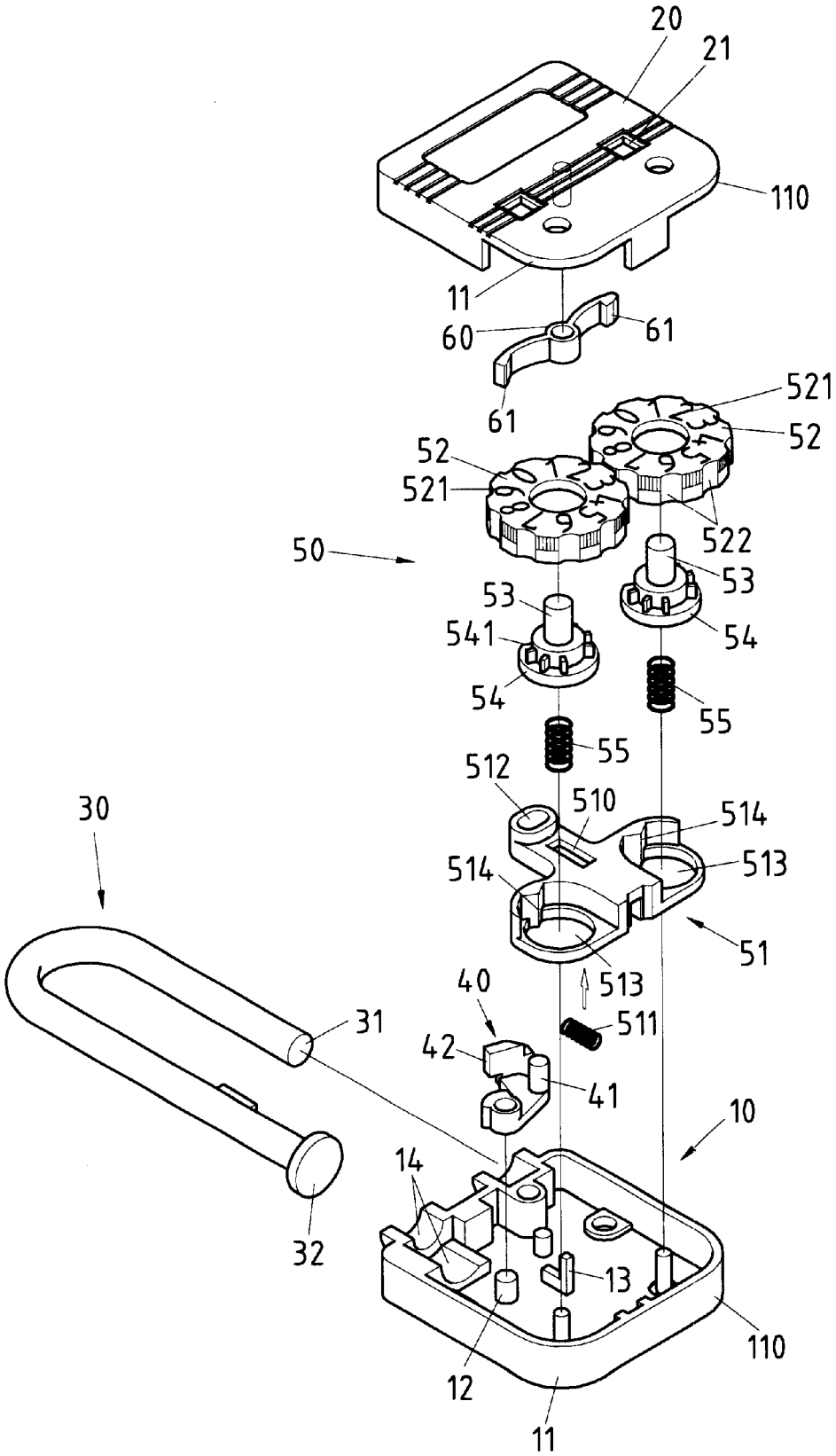
FIG. 3 shows a complete exploded view of the preferred embodiment of the present invention.
Figure 4:
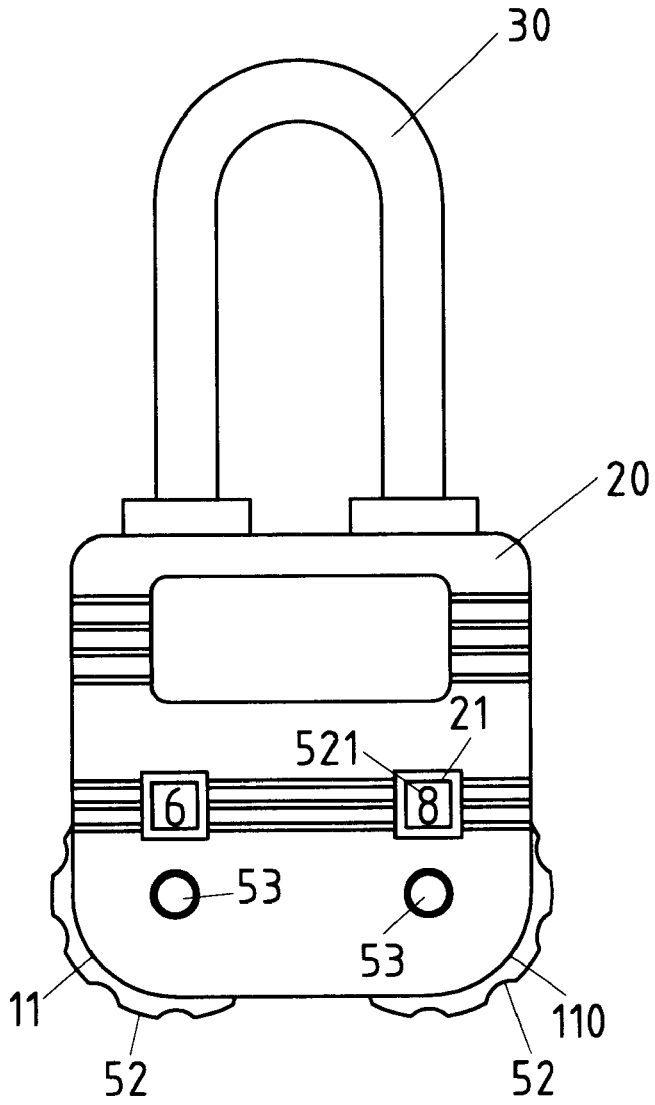
FIG. 4 shows a schematic plan view of the prefer-red embodiment of the present invention.
Figure 6:
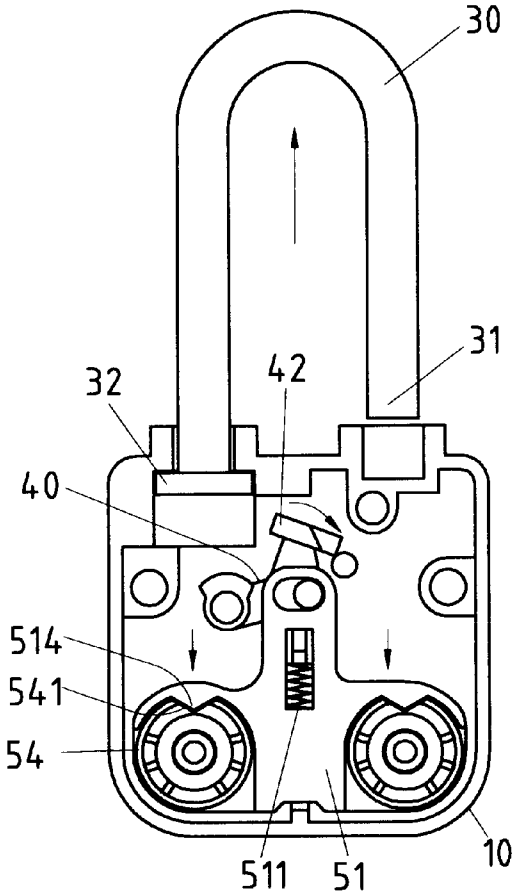
FIG. 6 shows a sectional schematic view of the preferred embodiment of the preferred embodiment of the present invention in action.
Figure 5:
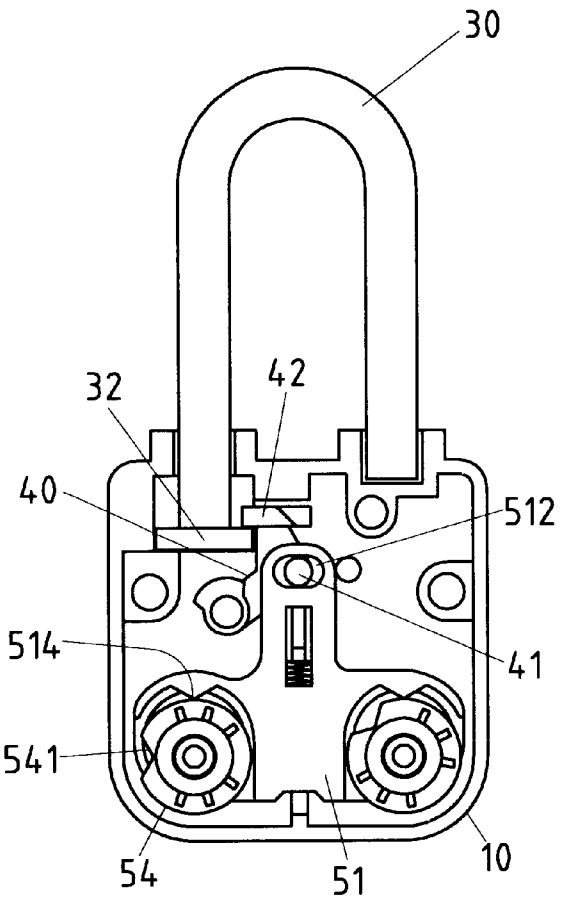
FIG. 5 shows a sectional schematic view of the preferred embodiment of the. present invention.

As shown in all drawings provided herewith, a combination padlock of the preferred embodiment of the present invention has a housing which is formed of a base 10 and a cover 20. The cover 20 is provided with two see-through windows 21. The combination padlock of the present invention comprises a shackle 30, a locating member 40, an actuation set 50, and an arresting member 60, which are either fastened to or disposed in the base 10.

The shackle 30 is of a U-shaped construction and is provided at one end with a retaining portion 32, and at an opposite end with a lock end 31. The retaining portion 32 is securely retained in a retaining slot 14 of the base 10.

The locating member 40 is provided with a guide pillar 41 and a stop block 42. The locating member 40 is retained by a retaining pillar 12 of the base 10. When the locating member 40 is turned on the pillar 12 of the base 10, the retaining portion 32 of the shackle 30 is stopped and positioned by the stop block 42 of the locating member 40.

The actuation set 50 is formed of a position confining seat 51, two dials 52, and two shaft rods 53 on which the two dials 52 are mounted. The position confining seat 51 is movably disposed in the base 10 and is provided with a receiving slot 510 for receiving a projection 13 of the base 10. The position confining seat 51 is provided with two fitting holes 513 for locating the support seats 54 of the two shaft rods 53 in conjunction with two springs 55. The fitting holes 513 are provided with a protruded edge 514, which is received in a recess 541 of the support seats 54. The position confining seat 51 is further provided with a through slot 512 for receiving the guide pillar 41 of the locating member 40. The receiving slot 0 and the projection 13 of the base 10 are urged by a recovery spring 511. The dials 52 are provided in the upper side with numerals 521, and in the rim with a plurality grooves 522 which are arranged at intervals.

The arresting member 60 is provided with two locating tongues 61, which are received in the grooves 522 of the two dials 52 at the time when the dials 52 are turned to a set series of numbers to unlock the padlock.

Figure 7:
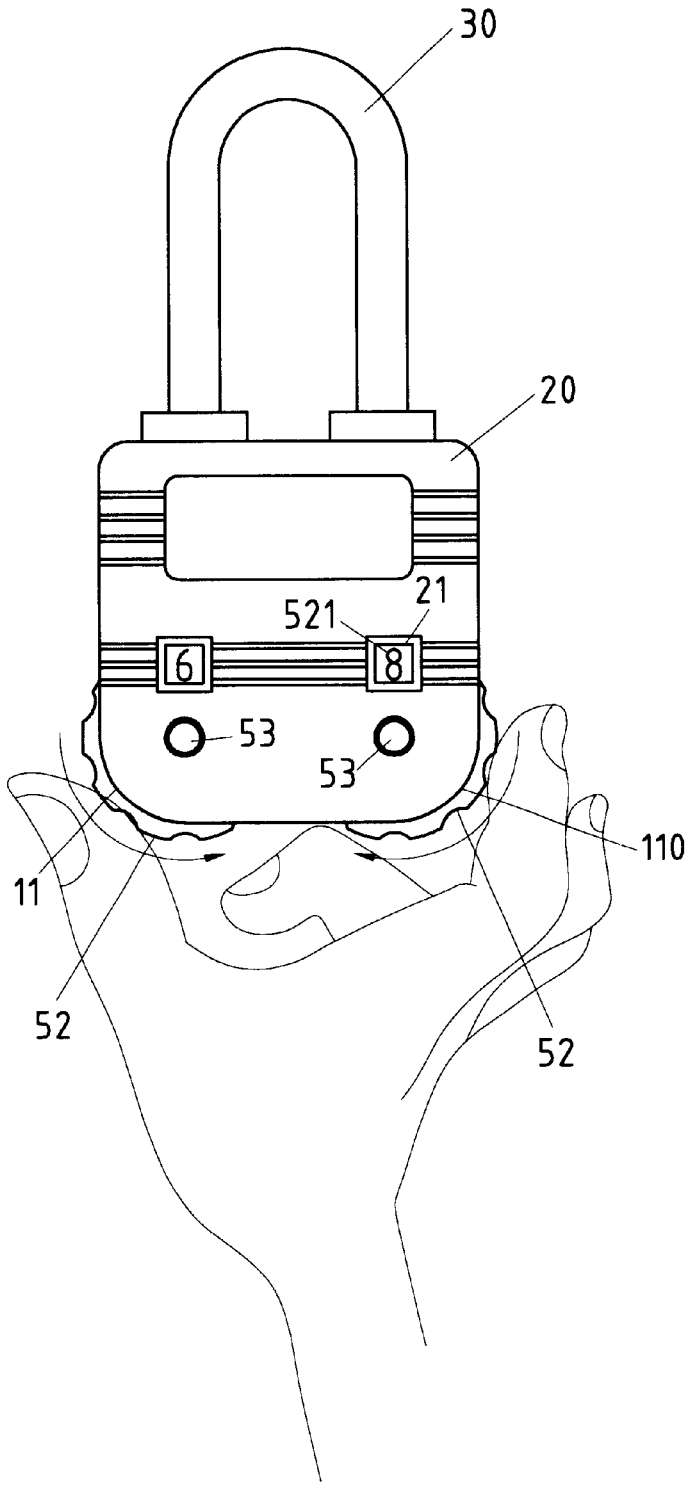
FIG. 7 shows a schematic view of the preferred embodiment of the present invention in operation.
Figure 8:
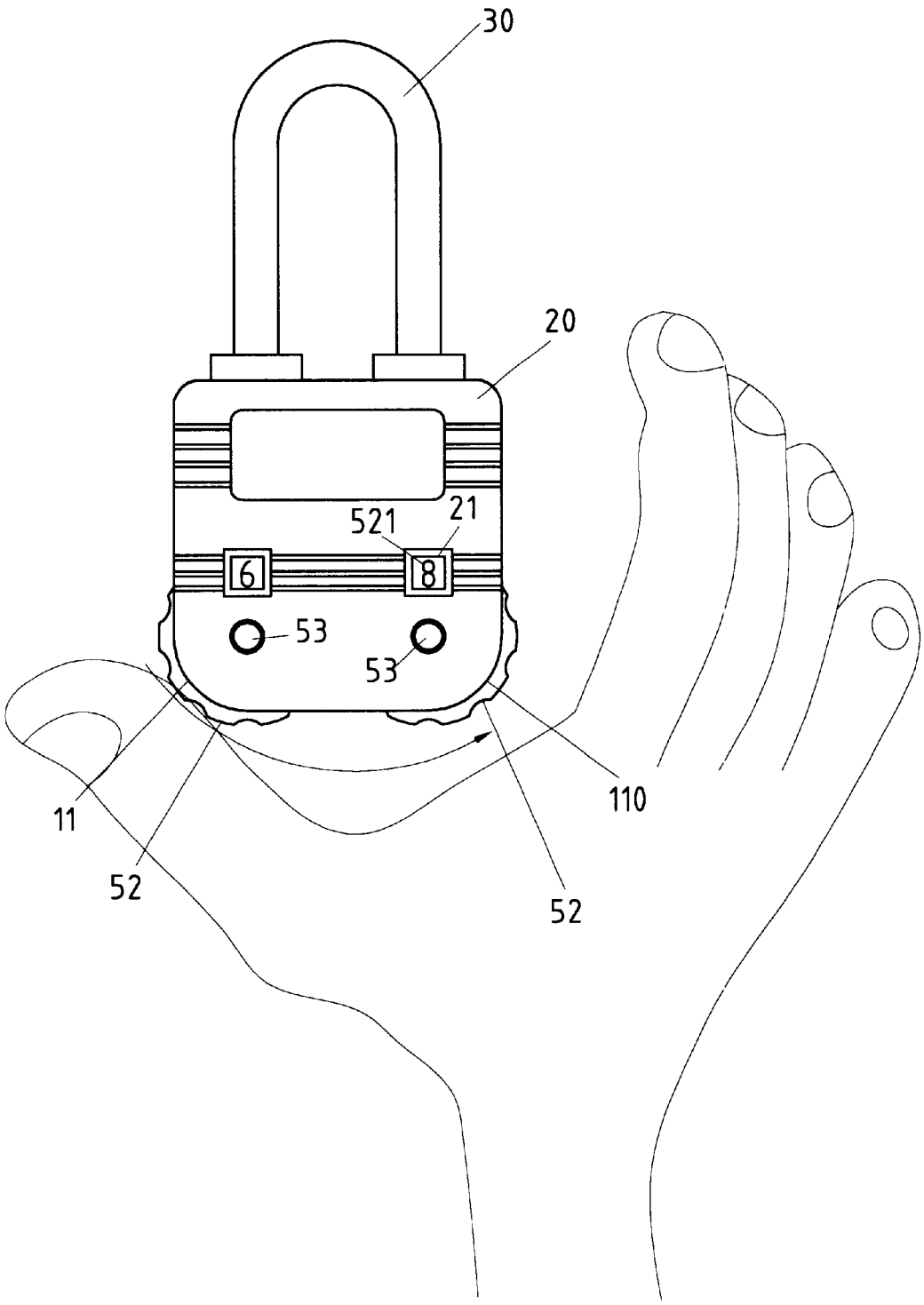
FIG. 8 shows another schematic view of the preferred embodiment of the present invention in operation.

The present invention is characterized by the two dials 52 which are mounted on two shaft rods 53 such that the two dials 52 turn independently. In addition, the numerals 521 of the dials 52 are disposed on the upper surface of the dials 52 such that the numerals 521 can be seen through the see-through windows 21 of the cover 20. The cover 20 is provided in a side wall with two cuts 11 and 110, via which the rims of the two dials 52 jut out of the housing of the padlock to facilitate the turning of the two dials 52 with fingers at the same time, as shown in FIG. 7.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following claim.

I claim:

1. A combination padlock comprising:

a housing having a base with a cover positioned thereover, said cover having a first see-through window and a second see-through window, said base having a retaining pillar and a projection extending upwardly from a surface thereof;

a shackle of a U-shaped construction having a first leg with a retaining portion at an end thereof, said retaining portion retained within said housing, said shackle having a second leg releasably retained within said housing, said second leg being in parallel relation to said first leg;

a locating member having a guide pillar and a stop block, said locating member being pivotally retained by said retaining pillar within said housing, said locating member pivotable on said retaining pillar to a first position in which said stop block of said locating member abuts a surface of said retaining portion of said shackle so as to retain said retaining portion in an inward position in said housing;

an actuation seat having a position confining seat and a circular first dial and a second circular dial confined by said position confining seat in said base, said position confining seat having a receiving slot slidably receiving said projection of said base, said position confining seat having a first fitting hole receiving said first dial therein and a second fitting hole receiving said second dial therein, said position confining seat having a through slot pivotally receiving said guide pillar of said locating member therein, each of said first and second dials having numerals marked thereon such that a numeral of each of said dials corresponds in location to respective see-through windows of said cover, each of said two dials having a plurality of grooves formed in a rim thereof, said plurality of grooves being formed at even radial intervals around a periphery of said rim, said first dial being rotatable about a central axis that is parallel to a central axis about which said second dial rotates, said first leg of said shackle extending in transverse relationship to a plane extending across said central axes of said first and second dials; and an arresting member having a first locating tongue and a second locating tongue, said first locating tongue releasably received within one of said plurality of grooves of said first dial as said first dial is turned, said second locating tongue releasably received within one of said plurality of grooves of said second dial as said second dial is turned, said cover having a first cutout area extending across a portion of a bottom and across a portion of one side wall of said cover, said cover having a second cut-out area extending across another portion of said bottom and across a portion of another side wall of said cover, said actuation seat further comprising:

first and second shaft rods supported respectively by first and second support seats, said first and second support seats respectively received by said first and second fitting holes of said position confining seat, said first dial mounted on said first shaft rod, said second dial mounted on said second shaft rod, said first and second dials being rotatable independently of each other, the rim of said first dial having a portion extending outwardly of said housing through said first cut-out area, the rim of said second dial having a portion extending outwardly of said housing through said second cut-out area.

* * * * *